United States Patent [19]

Rank

[11] 4,432,668

[45] Feb. 21, 1984

[54] FOOT JOINT FOR CONNECTING A MOVABLE SERVICE TOWER OF AN OFF-SHORE STATION TO A FOUNDATION

[75] Inventor: Werner Rank, Oberhausen, Fed. Rep. of Germany

[73] Assignee: M.A.N. Maschinenfabrik Augsburg-Nürnberg Aktiengesellschaft, Fed. Rep. of Germany

[21] Appl. No.: 407,797

[22] Filed: Aug. 13, 1982

[30] Foreign Application Priority Data

Aug. 19, 1981 [DE] Fed. Rep. of Germany ..... 3132711

[51] Int. Cl.[3] ..... E02B 17/00; E02D 27/04

[52] U.S. Cl. ..... 405/202; 403/122; 405/195

[58] Field of Search ..... 405/202, 195, 203, 204, 405/224, 225; 403/122, 76, 135; 212/253, 245; 308/2 R; 175/9; 166/350, 359

[56] References Cited

U.S. PATENT DOCUMENTS

| | | | |
|---|---|---|---|
| 856,713 | 6/1907 | Lovley | 405/202 X |
| 1,272,110 | 7/1918 | Robinson | 405/202 X |
| 2,079,663 | 5/1937 | Rasmussen | 212/253 |
| 2,089,439 | 8/1937 | Silberstein | 403/122 X |
| 3,154,333 | 10/1964 | Townsend | 403/122 |
| 3,522,709 | 8/1970 | Vilain | 405/202 |
| 3,708,985 | 1/1973 | Pogonowski et al. | 405/202 |
| 3,735,597 | 5/1973 | Guy | 403/122 X |
| 3,766,582 | 10/1973 | Lloyd et al. | 405/202 |
| 4,137,722 | 2/1979 | Mossiossian et al. | 405/202 |

FOREIGN PATENT DOCUMENTS

| | | | |
|---|---|---|---|
| 2066336 | 7/1981 | United Kingdom | 405/202 |

*Primary Examiner*—Dennis L. Taylor
*Attorney, Agent, or Firm*—McGlew and Tuttle

[57] ABSTRACT

In a ball joint accessible for inspection and connecting the service tower of an offshore station to the foundation on the sea bottom, one side of a spherical joint part is firmly connected through a neck to the foot of the tower, and the other side of the spherical part is mounted for universal motion within a joint casing which is anchored to the foundation. The two parts of the joint are connected to each other by a tension member. The spherical joint part is seated on exchangeable supporting bearings 11 which are provided within the joint casing and are well accessible. The top of the joint casing is formed by a cover ring having a collar designed as a spherical zone. From above, the ball joint is sealed and protected by a spherical cap in which an air cushion is maintained. The gap between the cover ring and the spherical joint part is sealed by a stuffing box.

20 Claims, 5 Drawing Figures

FOOT JOINT FOR CONNECTING A MOVABLE SERVICE TOWER OF AN OFF-SHORE STATION TO A FOUNDATION

FIELD AND BACKGROUND OF THE INVENTION

The present invention relates in general to off-shore stations and in particular to a new and useful foot joint for connecting a movable service tower of an off-shore station to a fixed foundation at the sea bottom.

A foot joint for a movable service tower of an off-shore station is known from German patent No. 2,549,859. In this construction, the joint part secured to the foot of the tower is designed as an external spherical zone moving with the tower while sliding on a stationary spherical joint part which is immovably connected to the foundation. The design of the sliding surfaces of such a ball joint is described in German OS No. 27 55 592. In the sliding zone between the two hemispherical shells, exchangeable spherical sliding shoes are secured to one part, and slide on the spherical surface of the opposite part while the spherical gap therebetween is maintained and are lined with a material having a low coefficient of friction. The sliding zone between the hemispherical shells is protected from above and below by annular seals closing the gap therebetween.

The sliding shoes in the relatively narrow gap between the hemispherical shells are accessible only upon removing the upper seal. Consequently, no visual monitoring of the function and condition is possible. Because of the narrow space and the geometry of the gap, the exchange of the spherical sliding shoes and of the upper seal is difficult. The manufacture of the ball joint, especially the working of the hemispherical shells and the sliding shoes, is very expensive.

SUMMARY OF THE INVENTION

The present invention is directed to an improved design of a foot joint which allows free access to the parts that are exposed to wear, particularly the bearing plates and the packing of the stuffing box, and thus permitting a continual monitoring and maintenance and, if necessary, an easy exchange of the parts, and also simplifying the manufacture of the joint. Another objective of the invention is to facilitate the anchoring of the joint, and thus of the tower, to the foundation or the sea bottom and to give the accessible space satisfactory dimensions for a variety of uses.

Accordingly a further object of the invention is to provide a foot joint for connecting a movable service tower of an off-shore station to a structural part anchored to the sea bottom comprising a tension member connected between the tower and the structural part, a spherical joint part connected to a lower end of the tower, a shell casing connected to the structural part and defining a space for at least part of said spherical joint part, a plurality of bearings connected to said shell casing and slidably supporting said spherical joint part, a cover ring connected to said shell casing and extending toward said spherical joint part, a collar having a spherical section shape connected to said cover ring and extending around a part of said spherical joint part and defining a gap therewith, and a stuffing seal box in said gap for sealing said gap and said space.

To hold the two parts of the joint assembled, the spherical part connected to the tower is pulled toward the seats of the supporting bearings by means of a tension member. The tension member is firmly fixed to the base of the tower and, on the other side, anchored to the foundation through a universal joint. The universal joint is so disposed that its axes of rotation intersect at the center of the ball joint.

The supporting bearings are equidistantly located in a circle having a diameter which is smaller than the great circle of the spherical part, on brackets which are mounted on the cylindrical shell of the casing or on the base plate. Each supporting bearing comprises a bearing base, a bearing seat comfortable to the surface of the joint ball, and a hydraulic cylinder which is mounted between the bearing base and the bearing seat and bears against these parts through spherical end plates and mating ball sockets. The hydraulic cylinders of all the supporting bearings communicate with each other. This is to equalize the forces acting on the bearings as the tower moves, and thus also to continually balance the reaction forces acting on the casing of the joint and on the foundation. The mounting of the hydraulic cylinders in ball sockets ensures a permanently correct engagement between the contacting surfaces and a secure transmission of forces to the bearing brackets. The bearing seats are dimensioned, for a hydrostatic mounting of the spherical joint parts and lined with PTFE plates which are provided with grooves or chambers for a lubricant.

Lubricant is supplied to each of the bearing seats individually and independently by a central force-feed lubricating system. This makes sure that the supporting bearings can be exchanged without affecting the safety in operation of the ball joint.

The free access to the supporting bearings permits a permanent monitoring thereof and maintenance work at any time. The spherical part of the joint may be plated with a corrosion resisting material, and the polished spherical surface sliding on the bearings is widely accessible to an extent given by the inclined position of the tower, wherefore it also can continually be checked and, if necessary, easily stripped of deposits. This is an important advantage over the prior art manner of foot joint mounting.

The collar designed as a spherical zone of the cover ring, and the spherical cap in the shape of a diving bell, protect the spherical surface if the joint part connected to the tower and close the gap formed between these stationary and the movable parts at the level of the joint center.

This gap is sealed by a stuffing box which is accessible from the inside of the joint. The gland of the stuffing box is made in a plurality of parts, to allow repacking. The packing may be of the cup, lip or ring type, with a pressure oil ring. The gland may be readjusted manually, through electrically operated adjusting mechanisms, or by means of hydraulically or pneumatically operated actuators which act on the packing unit uniformly through arrestable tilting levers and a pressure ring.

To provide protection against various phenomena at the sea bottom, and to ensure its mobility, the foot joint is surrounded in its upper portion by a spherical or bell-shaped cap which is designed as a spherical zone and secured to the neck. Together with the collar of the cover ring of the joint casing, the spherical cap forms a water lock by confining an air cushion in the enclosed space which is under a pressure corresponding to the water depth. By means of probes provided in the wall of the collar, penetration of water in the air cushion space is monotored, and in case of need, an air pressure control is started. Under normal operating conditions, no water penetrates to the seal provided in the gap between the movable spherical part and the cover ring. The air escaping through the stuffing box into the interior of the joint serves the purpose of ventilating the space. Since the volume of the air cushion is relatively small, the pressure corresponding to the depth below sea level can easily be maintained.

The elements connecting the base plate to the foundation and thereby anchoring the foot joint are provided within the casing of the joint and comprise sealing means.

The manufacture of the inventive foot joint is advantageous in that only one outer spherical surface is to be machined, plated and polished, and that the cylindrical shell in the casing is simple in design and the cover ring requires only machining of the flange and of the seat for the stuffing box.

A development of the invention provides that outwardly extending secondary chambers are inserted in the wall of the cylindrical shell, which are provided on both sides with pressure-right closing means actuable through hydraulic systems and which can be pumped out or flooded through a pumping and compressed-air system.

The secondary chambers accommodate rope winches intended for resisting the operation of lowering the tower to the foundation. Preferably, at least three secondary chambers are equipped with rope winches. To ensure the safety of the maintenance crew, an escape apparatus is stationed in at least one secondary chamber. According to another development of the invention, the secondary chambers are equipped with means for connecting further, satellite chambers.

A further object of the invention is to provide a foot joint for connecting a movable service tower of an off-shore station to a stationary part anchored at the sea bottom which is simple in design, rugged in construction and economical to manufacture.

DESCRIPTION OF THE PREFERRED EMBODIMENT

Figure 1:
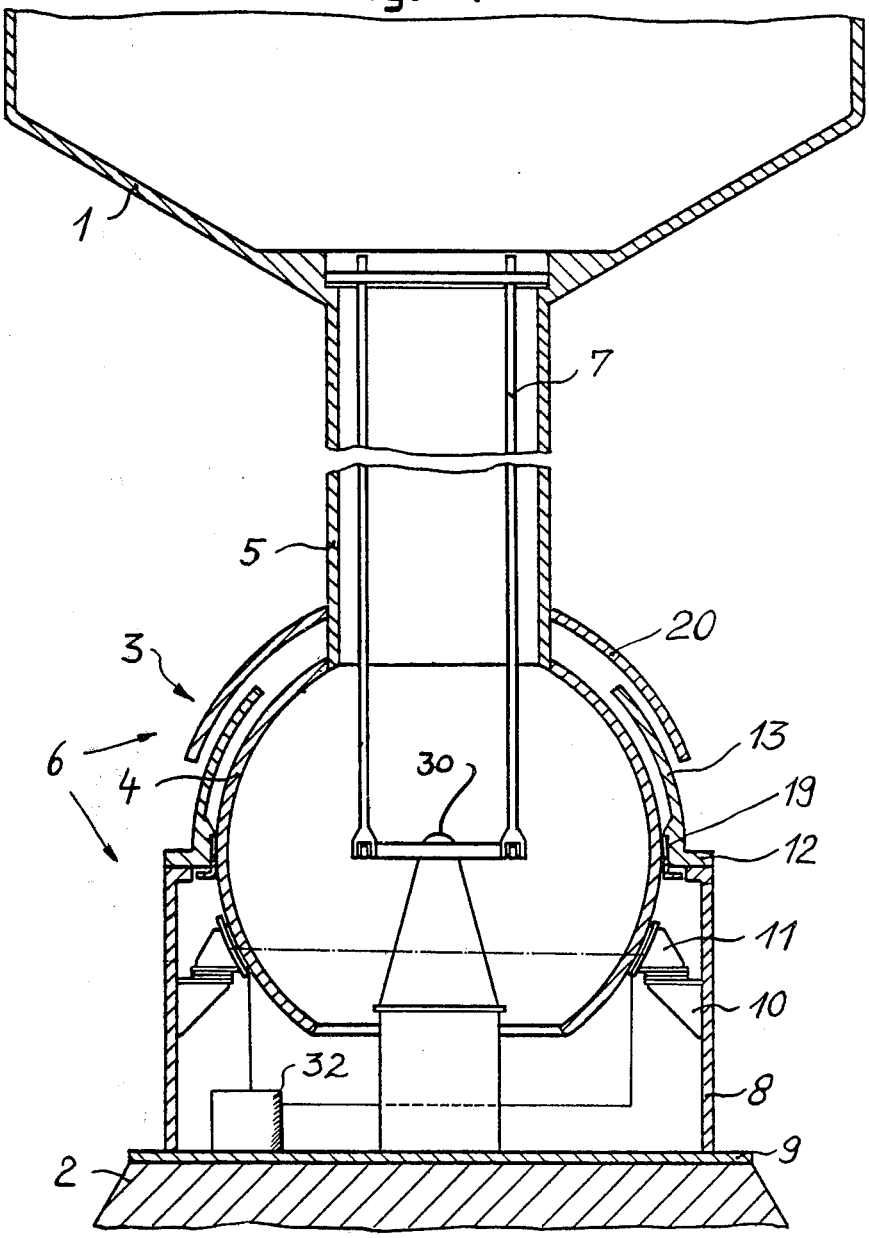
FIG. 1 is a sectional view of the ball joint.

Referring to the drawings, and in particular in FIG. 1, the ball joint 3 of the invention which permits a universal pivoting of the service tower 1, is provided between the tower and a foundation 2. One part of the joint, which is designed as a ball or spherical part 4, is firmly connected by one side to the foot of tower 1, through a neck 5, and movably mounted by its other side in a joint casing 6 which is anchored to foundation 2. Part 4 and casing 6 of the joint are connected to each other by a tension member 7 which is universally movable above the center of ball joint 3 and is firmly fixed by one side to the foot of service tower 1 and anchored by its opposite side and through casing 6 to the foundation. Member 7 is connected at a universal joint 30, to foundation 2, with joint 30 being positioned near the center of part 4. Tension member 7 may be adjustable in length.

Figure 2:
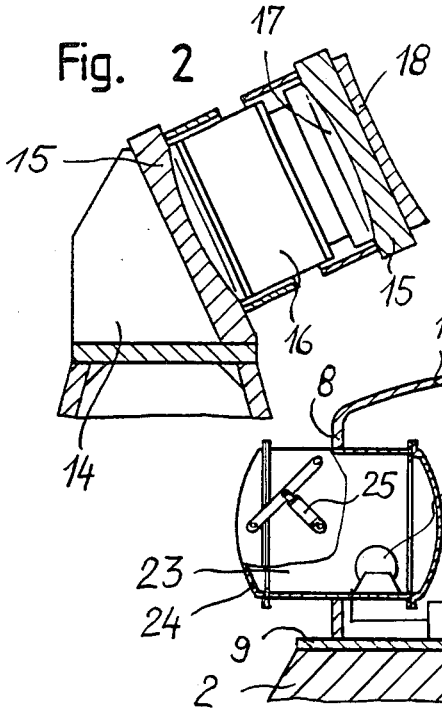
FIG. 2 is an enlarged sectional view of a supporting bearing.
Figure 4:
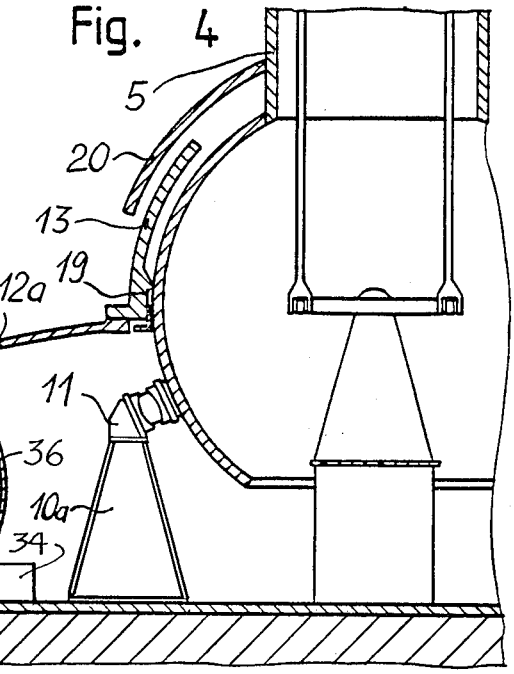
FIG. 4 is a partial sectional view of the joint with an inserted secondary chamber.
Figure 5:
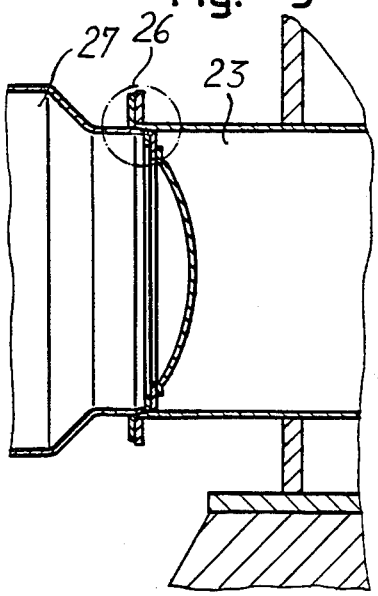
FIG. 5 shows the connection of a satellite chamber to a secondary chamber.

Spherical part 4 of the joint is provided above and below with openings through which not only the tension member 7 is passed but also supply lines and oil conveying pipes may extend and which also serve as manholes to make casing 6 accessible. Casing 6 comprises a cylindrical shell 8, a base plate 9, a plurality of supporting bearings 11 which are mount-on brackets 10, **10*a*, a cover ring 12, 12*a*, and a collar 13 which is designed as a spherical zone. See also FIG. 4 where similar or like parts have the same number. According to FIG. 1, brackets 10 are secured to the inside of casing shell 8, and cover ring 12 with collar 13 are made in one piece. With a larger diameter of casing shell 8 according to FIG. 4, brackets 10*a* may be provided on base plate 9 and cover ring 12*a* may be domed. FIG. 2 shows the construction of the supporting bearings 11 which are distributed below the horizontal central axis of the ball joint along a circle of a smaller radius, and comprise each, considered sequentially in the inward direction, a bearing base 14, a ball socket 15, a hydraulic cylinder 16 with spherical end plates 17 on both sides, another ball socket 15, and a bearing seat 18 having a smooth surface conformable to and facing the surface of spherical part 4 of the joint. The cylinder 16 of each bearing is connected to the other cylinders as shown schematically by a chain line in FIG. 1. Such supporting bearings are best adaptable to the movements of spherical part 4. Lubrication means 32 are provided for supplying lubricant to each seat 18. To seal casing 6 anchored to the foundation against spherical part 4 connected to tower 1, a stuffing box 19 is provided at the level of the center of the joint, which is secured to cover ring 12, or collar 13. A spherical ring cap 20 secured to neck 5 and surrounding the upper portion of ball joint 3 serves the purpose of protecting the joint against the ambiance at the sea bottom. Pressurized air fills the space between cap 20 and part 4**.

Figure 3:
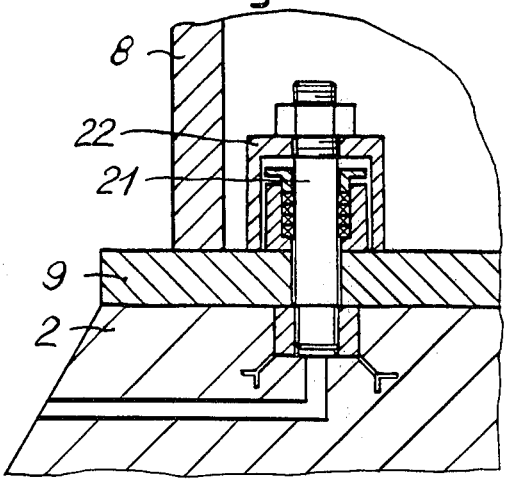
FIG. 3 shows how the casing of the joint is secured to the foundation.

FIG. 3 shows how casing 6 of the joint is anchored to foundation 2. The elements 21, such as bolts with nuts, for connecting base plate 9 to the foundation are provided within casing 6 and equipped with sealing means 22 such as an inverted cap member. These connecting elements may also be designed as hydraulically or pneumatically actuated locking mechanisms. According to a further development of the invention, a plurality of secondary chambers 23 are provided at the periphery of casing shell 8. Secondary chambers 23 are equipped with pressure-tight closing means or hatches 24 which are actuated through hydraulic system 25. Compressed-air means or system 34 is connected to chambers 23 for flooding or filling the chambers with air. Rope winches 36 set up in at least three equally spaced secondary chambers 23 simplify the operations of lowering the tower and securing ball joint 3 to foundation 2. Secondary chambers 23 may also be provided with means 26 for connecting further chambers, so-called satellite chambers 27 which may be used as supply receptacles or the like.

While a specific embodiment of the invention has been shown and described in detail to illustrate the application of the principles of the invention, it will be understood that the invention may be embodied otherwise without departing from such principles.

What is claimed is:

1. A foot joint for connecting a movable service tower of an offshore station to a structural part anchored to the sea bottom comprising:

a tension member connected between the tower and the structural part;

a spherical joint part connected to the lower end of the tower;

a shell casing connected to the structural part and defining a space for receiving at least a portion of said spherical joint part;

a plurality of bearings connected to said shell casing and slidably supporting said spherical joint part;

a cover ring connected to said shell casing and extending toward said spherical joint part;

a collar having a spherical section shape, connected to said cover ring and extending around a portion of said spherical joint part and defining a gap with said spherical joint part; and a stuffing seal box in said gap for sealing said gap and said shell casing space.

2. A foot joint according to claim 1, wherein said tensioning means is connected to the structural part by means which permit universal movement of said tensioning member with respect to the structural part.

3. A foot joint according to claim 1, wherein said shell casing comprises a cylindrical shell and a base plate connected to said cylindrical shell firmly secured to said structural part.

4. A foot joint according to claim 1, wherein said plurality of bearings are equidistantly located around a periphery of said spherical joint part and along a circle having a diameter smaller than a great circle of said spherical joint part.

5. A foot joint according to claim 4, wherein each of said bearings is connected to said cylindrical shell over a mounting bracket.

6. A foot joint according to claim 4, wherein each of said bearings is mounted to said base plate over a mounting bracket.

7. A foot joint according to claim 1, wherein each of said bearings comprises a bearing base connected to said casing shell, a bearing seat which has an outer surface conforming in shape to an outer surface of said spherical joint part for engagement with said spherical joint part, a hydraulic cylinder/piston unit between said bearing base and bearing seat.

8. A foot joint according to claim 7, including a ball socket formed on facing surfaces of each of said bearing base and bearing seat, said hydraulic cylinder/piston unit having outer cylindrical plates engaging respective ones of said ball sockets.

9. A foot joint according to claim 8, wherein said hydraulic cylinder of each of said bearings communicates with a hydraulic cylinder of each other of said bearings.

10. A foot joint according to claim 7, including lubirication means connected to each bearing for supplying lubricant to each bearing seat.

11. A foot joint according to claim 1, including a multi-part spherical section shaped cap connected to and extending outwardly from the tower and over a portion of said spherical joint part and at least a portion of said collar, said cap forming a water lock space with said collar and spherical joint part for receiving pressurized air to exclude water from said water lock space.

12. A foot joint according to claim 3, including connecting elements connected to the structural part and said shell casing plate, and sealing means associated with said connecting elements for sealing an area of connection between said shell casing plate and the structural part.

13. A foot joint according to claim 3, including at least one secondary chamber extending outwardly and through said cylindrical shell of said shell casing.

14. A foot joint according to claim 13, wherein said secondary chamber defines a space and has, at each end thereof, pressure tight closing means which is actuatable to open and close said secondary chamber space.

15. A foot joint according to claim 14, including a compressed air system connected to said secondary chamber for selectively flooding said secondary chamber space with water and filling said secondary chamber space with air.

16. A foot joint according to claim 13, including a plurality of said secondary chambers equidistantly distributed around said cylindrical shell each equipped with a rope winch.

17. A foot joint according to claim 13, including escape apparatus provided in said secondary chamber.

18. A foot joint according to claim 16, wherein three of said secondary chambers are provided.

19. A foot joint according to claim 13, wherein said secondary chamber is equipped with means for connecting additional satellite chambers to said shell casing.

20. A foot joint according to claim 1, wherein said stuffing seal box can be readjusted and restuffed through one of electrically, pneumatically and hydraulically driven actuators.

* * * * *